US007278691B2

(12) United States Patent
Xiang

(10) Patent No.: US 7,278,691 B2
(45) Date of Patent: Oct. 9, 2007

(54) ARTICLE OF FURNITURE HAVING A RECESSED SURFACE FOR A CUSHION

(75) Inventor: Guangqiang Xiang, Linhai (CN)

(73) Assignee: Zhejiang Yongqiang group Co., Ltd., Linhai, Zhejiang Province (CN)

( * ) Notice: Subject to any disclaimer, the term of this patent is extended or adjusted under 35 U.S.C. 154(b) by 0 days.

(21) Appl. No.: 11/419,288

(22) Filed: May 19, 2006

(65) Prior Publication Data

US 2007/0001496 A1 Jan. 4, 2007

(51) Int. Cl.
*A47C 7/00* (2006.01)

(52) U.S. Cl. ..... 297/440.2; 297/451.9; 297/446.2; 297/452.56; 297/440.11

(58) Field of Classification Search ..... 297/440.2, 297/440.22, 446.1, 446.2, 451.9, 440.11, 297/440.14, 440.21, 452.56
See application file for complete search history.

(56) References Cited

U.S. PATENT DOCUMENTS 257,439 A * 5/1882 Ellis ..... 297/452.55
1,340,475 A * 5/1920 Collar ..... 5/404
1,840,275 A * 1/1932 Nuberg ..... 5/402
2,907,377 A * 10/1959 Hoven et al. ..... 297/440.2
3,159,428 A * 12/1964 Schier ..... 297/452.65
3,663,059 A * 5/1972 Omlie ..... 297/440.2
3,736,022 A 5/1973 Radke
3,972,565 A * 8/1976 Smith ..... 297/452.48
3,981,536 A * 9/1976 Schultz ..... 297/440.2
4,768,833 A * 9/1988 Virtue ..... 297/440.2
5,690,384 A 11/1997 Rossi

* cited by examiner

*Primary Examiner*—David Dunn
*Assistant Examiner*—Erika Garrett
(74) *Attorney, Agent, or Firm*—Alston & Bird, LLP

(57) ABSTRACT

An article of furniture having a removable seat or back cushion. The design includes a frame having a recessed cushion support surface that creates a rim that defines a pocket that allows a seat or back cushion having first and second portions to be securely attached to the article. The first cushion portion is placed adjacent the recessed support surface, and a peripheral lip of the first portion is placed into the pocket in order to secure the cushion to the frame. The second portion provides the user contact surface. In one embodiment, the second portion substantially obscures the edge of the rim from view. As a result, the present invention maintains the aesthetic appeal of an article of furniture having removable seat or back cushions, while providing a more secure and relatively unobvious attachment of the cushions.

10 Claims, 2 Drawing Sheets

ARTICLE OF FURNITURE HAVING A RECESSED SURFACE FOR A CUSHION

BACKGROUND OF THE INVENTION

1) Field of the Invention

The present invention relates to articles of furniture in general, and more particularly to articles of furniture that have removable cushion surfaces.

2) Description of Related Art

There are various characteristics that are important in the design and manufacture of articles of furniture. One of those characteristics is performance, for example, the ability of a chair to bear the weight of a person or the ability of bookshelf to bear the weight of an item or group of items. Another characteristic is comfort, for example, the ability of a chair to provide comfortable seat and back surfaces. Other characteristics include cost, aesthetics, and convenience. Often the most difficult job for a furniture designer is to balance these characteristics, among others, to provide an article of furniture that appeals to a broad range of consumers.

In order to produce an article of furniture that creates a desired balance between these characteristics, many furniture manufacturers have designed articles that have removable, rather than integral, components. By designing removable components, furniture manufacturers are able to produce articles at a lower cost. For example, many removable components may be manufactured with a standard design, allowing customization to occur at the point of sale, for example by allowing a consumer to choose a cover material to be applied to the removable components after the sale. Furniture manufacturers have also found that in certain instances, removable components make moving an article more convenient, by allowing the removable components to be removed and moved separately. Many furniture manufactures have also found that articles of furniture, such as chairs and couches designed with removable seat or back cushions, have a pleasing casual appearance that many consumers prefer for outdoor furniture, such as patio, deck, and sunroom furniture. Designing removable components also allows articles of furniture to be made with a mixture of materials, for example chairs and couches made out of wicker often include seat and back cushions that are removable from the chair or couch frame. However, some articles of furniture with removable components suffer from difficulties. For example, removable seat and back cushions designed for use with chairs or couches may not feel as secure as seat and back cushions that are integral with the chair or couch. For instance, removable cushions of prior art chairs and couches are especially susceptible to displacement during frequent use.

Therefore, there is a need for an improved design of an article of furniture having removable seat or back cushions. The design should provide secure attachment of the cushion to a support area, while maintaining the aesthetic appeal of an article of furniture having removable seat or back cushions. The design should be simple and cost effective.

BRIEF SUMMARY OF THE INVENTION

The present invention achieves the above objectives and others by providing an improved design of an article of furniture having removable seat or back cushions. The design includes a recessed cushion support surface that creates a rim defining a pocket that allows a seat or back cushion to be securely attached to the article. As a result, the present invention maintains the aesthetic appeal of an article of furniture having removable seat or back cushions, while providing a more secure, and relatively unobvious attachment of the cushions.

In one embodiment, the present invention provides an article of furniture comprising a frame, a removable seat cushion, and a removable back cushion. The frame comprises a seat support portion, a back support portion, and a plurality of legs supporting the seat support portion and the back support portion. The seat support portion is in an approximate horizontal orientation and has a seat support surface, a pair of lateral sides, and at least one other side extending between the lateral sides. The back support portion extends adjacent the seat support portion in a vertical or slightly reclined orientation. The back support portion includes a back support surface, a pair of lateral sides, and at least one other side extending between the lateral sides. The removable seat cushion provides a user surface and is supported by the seat support surface. The removable back cushion provides a user surface and is supported by the back support surface. In one embodiment, at least a part of the seat support surface or the back support surface is recessed thus creating a rim that extends inward from the lateral sides and the other side to define a pocket between the rim and the recessed support surface. The cushion supported by the recessed surface comprises a first portion and a second portion attached to the first portion. The first portion defines an inner support surface and the second portion defines an outer contact surface. The first portion further defines a peripheral lip that is inserted into the pocket such that the inner support surface is adjacent the recessed support surface and the outer contact surface comprises the user surface. In another embodiment, the rim further defines an inner rim edge, and wherein when the peripheral lip is inserted into the pocket, the inner rim edge is substantially obscured by the second portion of the cushion. Another embodiment further comprises a neck portion connecting the second portion to the first portion and wherein the first portion of the cushion supported by the recessed surface defines a first outer perimeter, the second portion defines a second outer perimeter, and the neck portion defines a neck outer perimeter, and wherein when viewed from an angle substantially normal to the outer contact surface of the second portion, the second outer perimeter is located within the first outer perimeter, and the neck outer perimeter is located within the second outer perimeter, such that the peripheral lip of the first portion is defined as the part of the first portion located outside the neck outer perimeter. In another embodiment, the first portion further defines a first annular surface substantially perpendicular to the inner support surface and extending toward the second portion, and the second portion further defines a second annular surface substantially perpendicular to the outer contact surface and extending toward the first portion. In another embodiment, the seat cushion and the back cushion are comprised of unitary components. In another embodiment, the cushion supported by the recessed surface further comprises a first individual cushion element, a second individual cushion element, and a cushion cover having a first section, a second section, and an intermediate web connecting the second section to the first section, and wherein the cushion cover substantially surrounds the first and second cushion elements cushion such that the first portion comprises the first cushion element and the first section, the second portion comprises the second cushion element and the second section, and the neck portion comprises the intermediate web. In another embodiment, the intermediate web is structured to allow at least some independent movement of the first portion and the second portion. In another embodiment, the frame is constructed of a wicker material, the first and second cushion elements are constructed of a foam material, and the cushion cover is constructed of a fabric material.

In yet another embodiment, the present invention provides an article of furniture comprising a frame, a removable seat cushion, and a removable back cushion. The frame comprises a seat support portion, a back support portion, and a plurality of legs supporting the seat support portion and the back support portion. The seat support portion is in an approximate horizontal orientation and has a seat support surface, a pair of lateral sides, and a front side extending between the lateral sides. The back support portion extends adjacent the seat support portion in a vertical or slightly reclined orientation. The back support portion includes a back support surface, a pair of lateral sides, and a top side extending between the lateral sides. The removable seat cushion provides a user surface and is supported by the seat support surface. The removable back cushion provides a user surface and is supported by the back support surface. At least a part of the back support surface is recessed thus creating a rim that extends inward from the lateral sides and the top side to define a pocket between the rim and the recessed back support surface. The back cushion comprises a first portion and a second portion attached to the first portion. The first portion defines an inner support surface and the second portion defines an outer contact surface. The first portion further defines a peripheral lip that is inserted into the pocket such that the inner support surface is adjacent the recessed back support surface and the outer contact surface comprises the back cushion user surface.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
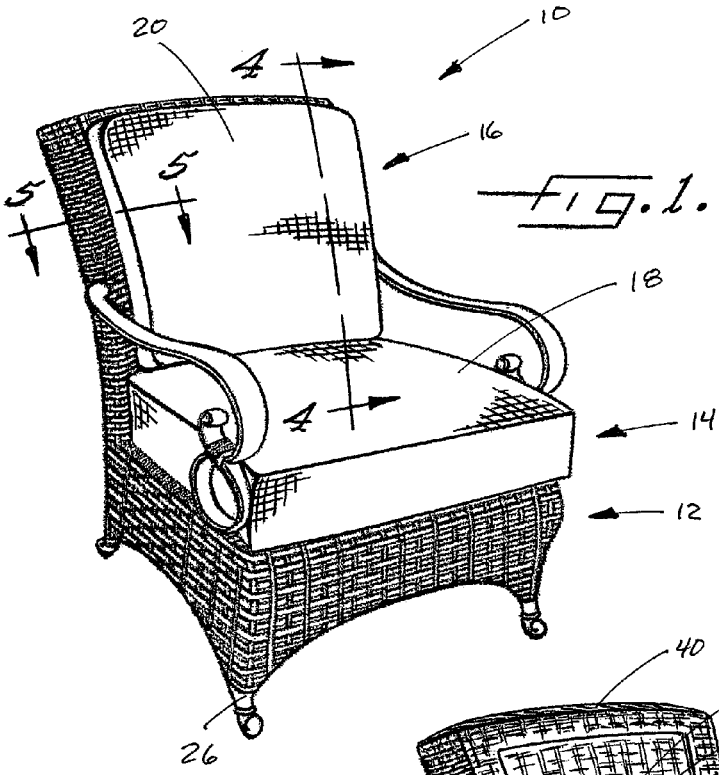
FIG. 1 is a perspective view of a chair having a frame, a seat cushion, and a back cushion in accordance with one embodiment of the present invention.
Figure 2:
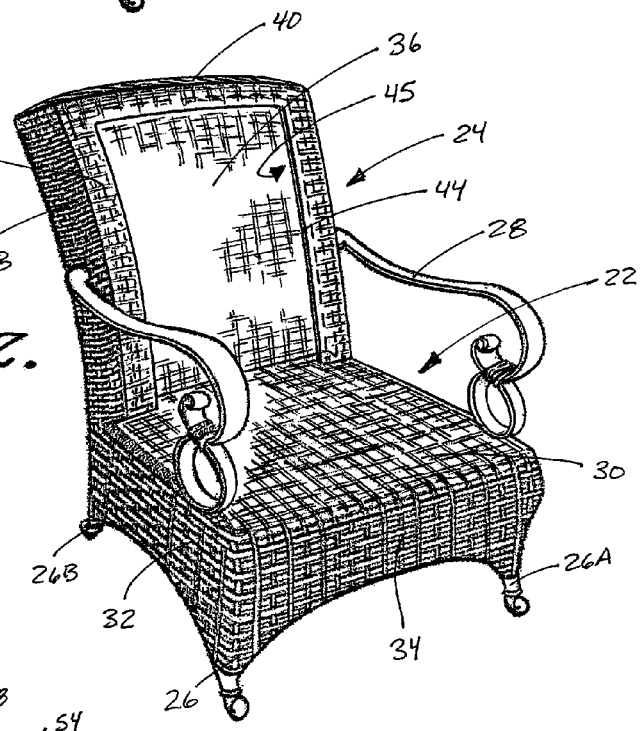
FIG. 2 is a perspective view of the chair of FIG. 1 in which the seat cushion and the back cushion have been removed to reveal a seat support surface and a recessed back support surface in accordance with one embodiment of the present invention.

The present invention relates to a variety of articles of furniture, including, but not limited to various chairs and couches. FIGS. 1 and 2 show an article of furniture in the form of a chair 10 in accordance with one embodiment of the present invention. Generally, the chair 10 of the depicted embodiment includes a frame 12, a removable seat cushion 14, and a removable back cushion 16. The seat cushion 14 defines a user surface 18 that provides a seating surface for a user. The back cushion 16 defines a user surface 20 that provides a back rest surface for the user. The frame 12 comprises a seat support portion 22, a back support portion 24, and four legs 26 that support the seat and back support portions 22, 24. The chair 10 of the depicted embodiment also includes two arm rests 28, although it should be noted that in other embodiments of the present invention, an article of furniture need not include armrests 28. In the depicted embodiment, the chair 10 is made of a woven material, such as a wicker material, however it should be noted that in other embodiments, an article furniture in accordance with the present invention may made of any material used for constructing furniture, including but not limited to wood materials, metal materials, plastic materials, composite materials, or combinations thereof.

In the depicted embodiment, the seat support portion 22 has generally horizontal orientation and includes a seat support surface 30 and a pair of lateral sides 32 approximately perpendicular to the seat support surface 30 and extending downward in an approximately vertical direction from the seat support surface 30. A front side 34 is also approximately perpendicular to the seat support surface 30 and extends downward in an approximate vertical direction from the seat support surface 30 such that it is also approximately perpendicular to the pair of lateral sides 32. Two front legs 26A help to support the seat support portion 30.

As shown in FIG. 2, in the depicted embodiment, the back support portion 24 extends adjacent an end of the seat support portion 22 opposite the front side 34 and has a general vertical or slightly reclined orientation. Two rear legs 26B help to support the back support portion 24 and the seat support portion 22. In the depicted embodiment, the back support portion 24 includes a back support surface 36 that is recessed. The back support portion 24 also includes a pair of lateral sides 38 extending along opposite sides of the back support surface 36, and a top side 40 extending between the lateral sides 38 and substantially perpendicular to the back support surface 36. A rim 42 is also defined that is approximately perpendicular to, and extends inward from, the top side 40 and the lateral sides 38. An inner rim edge 44 is defined by the inner boundary of the rim 42. So configured, the rim 42 defines a pocket 45 between the rim 42 and the recessed back support surface 36. The pocket 45 extends along the lateral and top sides 38, 40 of the back support surface 36 as shown in FIG. 2. Although the depicted embodiment shows a recessed back support surface 36, it should be noted that in other embodiments of the present invention, a seat support surface may be recessed and a pocket may be defined by a rim that overlies the recessed seat support surface in a similar manner as described above. Or in still other embodiments, both a seat support surface and a back support surface may be recessed, each including a rim and an associated pocket.

Figure 3:
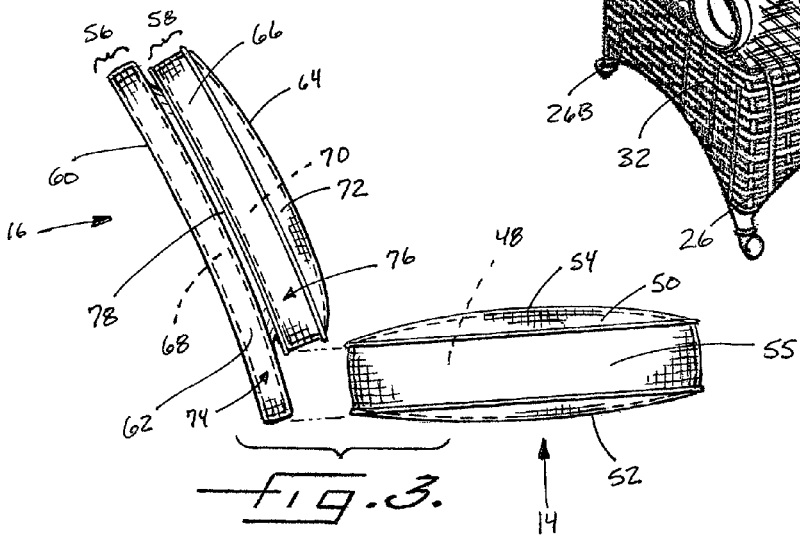
FIG. 3 is a side view of the seat cushion and the back cushion of the chair of FIG. 1 in accordance with one embodiment of the present invention.

FIG. 3 shows a seat cushion 14 and a back cushion 16 in accordance with the embodiment of the present invention of FIG. 1. In the depicted embodiment, the seat cushion 14 includes a seat cushion element 48 and a seat cushion cover 50. The seat cushion cover 50 substantially covers the seat cushion element 48 and conforms to the shape of the seat cushion element 48. The seat cushion 14 comprises an inner support surface 52, an outer contact surface 54, and an annular surface 55 that extends substantially perpendicular to the inner support surface 52 and the outer contact surface 54. In the depicted embodiment, the seat cushion element 48 is made of a foam material, however in other embodiments the seat cushion element 48 may be made of any material known to be used for seating support in the art of furniture design. In the depicted embodiment, the seat cushion cover 50 is made of a fabric material, however in other embodiments the seat cushion cover 50 may be made of any material know to be used for a seating surface.

As shown in the figure, the back cushion 16 includes a first portion 56 and a second portion 58. The first portion 56 defines an inner support surface 60, and a first annular surface 62 extending substantially perpendicular to the inner support surface 60 and toward the second portion 58. The second portion 58 includes an outer contact surface 64 and a second annular surface 66 extending substantially perpendicular to the outer contact surface 64 and toward the first portion 56. The first portion 56 of the back cushion 16 includes a first back cushion element 68 and the second portion 58 includes a second back cushion element 70. In the depicted embodiment, the first back cushion element 68 and the second back cushion element 70 are independent components and are joined together with a back cushion cover 72. However, in other embodiments, the first back cushion portion 56 and the second back cushion portion 58 may be part of a unitary cushion element. In still other embodiments, the first portion 56 and the second portion 58 may be connected with a neck portion. In the depicted embodiment, the back cushion elements 68, 70 are made of a foam material, however in other embodiments the back cushion elements 68, 70 may be made of any material known in the art of furniture design to be used for back support. The back cushion cover 72 is made of a fabric material, however in other embodiments the back cushion cover 72 may be made of any material know to be used for a back rest surface. In the depicted embodiment, the back cushion cover 72 includes a first section 74, a second section 76, and an intermediate web 78 that connects the second section 76 to the first section 74 and serves as a neck portion. The first section 74 of the back cushion cover 72 substantially covers the first back cushion element 68 such that the first back cushion cover section 74 conforms to the shape of the first back cushion element 68. Likewise, the second back cushion section 76 substantially covers the second back cushion element 70 such that the second back cushion cover section 76 conforms to the shape of the second back cushion element 70. The outer surface 64 of the second back cushion section 76 provides an outer contact surface that serves as the user back surface 20. The intermediate web 78 of the back cushion cover 72 joins the two back cushion elements 68, 70, and in the depicted embodiment, allows some independent movement of the second back cushion portion 58 relative to the first back cushion portion 56. As will be discussed in more detail below, this independent movement provides additional comfort for a user seated in the depicted chair 10. As shown in FIG. 1, the seat cushion inner support surface 52 is supported by the seat support surface 30 of the seat support portion 22 of the frame 12, and the outer contact surface 54 provides the seat user surface 18. Likewise, the back cushion inner support surface 60 is supported by the back support surface 36, and the outer contact surface 64 provides the back user surface 20.

Figure 6:
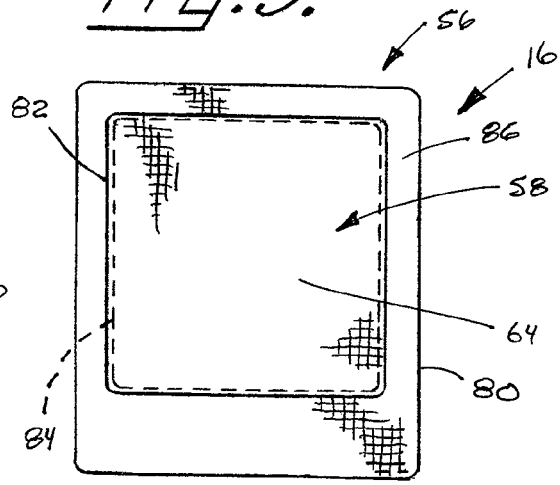
FIG. 6 is a front view of the back cushion of the chair of FIG. 1 in accordance with one embodiment of the present invention.

FIG. 6 shows a front view of the back cushion 16 in accordance with the embodiment of the present invention of FIG. 3. In the depicted embodiment, the first portion 56 of the back cushion portion 16 defines a first outer perimeter 80 that extends around the outer boundary of the first cushion portion 56 and the second portion 58 defines a second outer perimeter 82 that extends around the outer boundary of the second cushion portion 58. The intermediate web 78 also includes a web outer perimeter 84 that extends around the outer boundary of the intermediate web 78. In the depicted embodiment, when viewed from an angle substantially normal to the outer contact surface 64 of the second back cushion portion 58, a peripheral lip 86 is defined as the part of the first back cushion portion 56 that exists outside the web outer perimeter 84. It should be noted that although the depicted embodiment shows the second outer perimeter 82 within the first outer perimeter 80, in other embodiments of the present invention, at least a part of the second outer perimeter 82 may be outside the first outer perimeter 80. Additionally, in other embodiments, the first outer perimeter 80 and the web outer perimeter 84 may be aligned.

Figure 4:
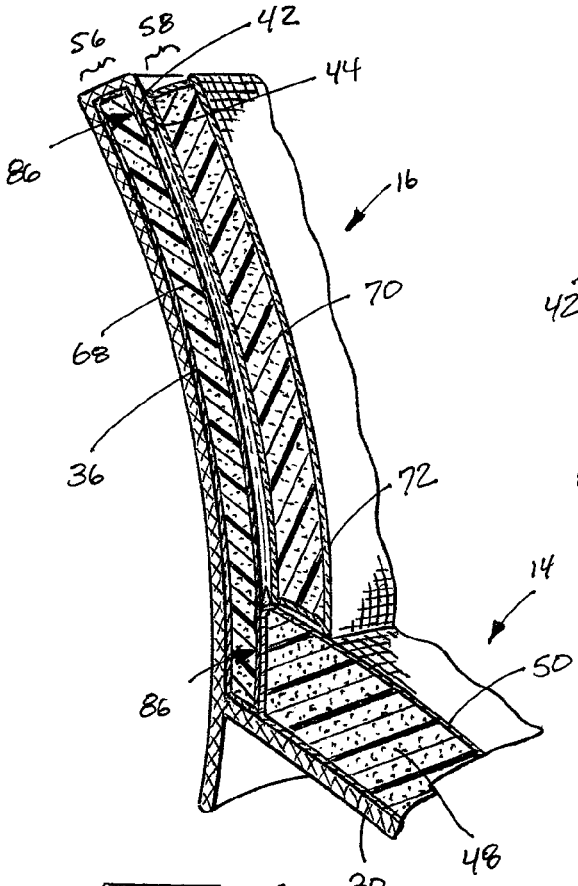
FIG. 4 is a partial cross section view showing a part of the back support portion and the seat support portion supporting the back cushion and the seat cushion of the chair of FIG. 1 in accordance with one embodiment of the present invention.
Figure 5:
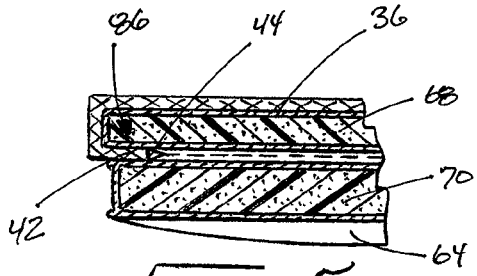
FIG. 5 is a partial cross section view showing a part of the back support portion and the back cushion of the chair of FIG. 1 in accordance with one embodiment of the present invention.
Figure 7:
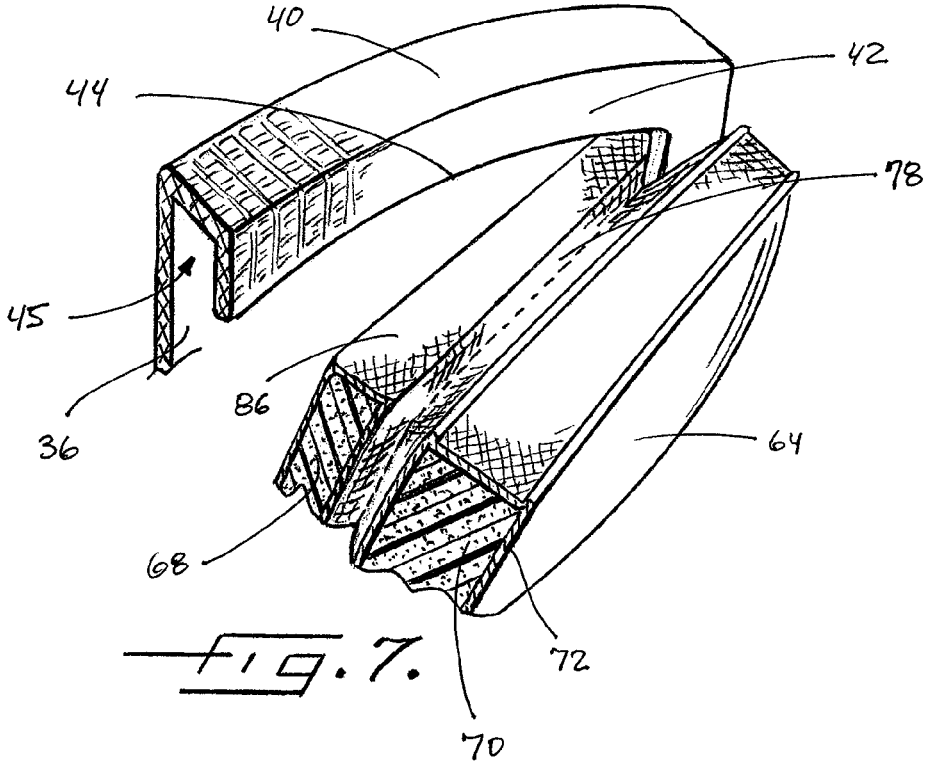
FIG. 7 is partial section view showing a first portion of the back cushion being inserted under a rim of the back support portion of the chair of FIG. 1 in accordance with one embodiment of the present invention.

FIGS. 4 and 5 show a partial cross section view of a seat cushion 14 and a back cushion 16 used with a chair 10 in accordance with one embodiment of the present invention. As shown in the figures, the seat cushion 14 is supported by the seat support surface 30 and the back support cushion 16 is supported by the back support surface 36. As also shown in the figure, the first portion 56 of the back cushion 16 is placed adjacent the recessed back support surface 36. When the back cushion 16 of the depicted embodiment is placed adjacent the recessed back support surface 36, the peripheral lip 86 of the first cushion portion 56 is inserted underneath the rim 42 and into the pocket 45 as shown in FIG. 7. The seat cushion 14 is placed on top of the seat support surface 30 adjacent the bottom of the peripheral lip 86 of the first back cushion portion 56. As shown in the figures, the first portion 56 of the back cushion portion 16 is adjacent the recessed back support surface 36 such that the back cushion cover intermediate web 78 is located adjacent the rim edge 44 of the back support portion 24 and the peripheral lip 86 of the first portion 56 is captured by the pocket 45. By capturing the peripheral lip 86 of the back cushion 16 in the pocket 45, the back cushion 16 is secured to the frame 12.

As noted above, the relative movement offered by the intermediate web 78 provides the level of comfort expected of an article of furniture having removable cushions. However, because the back cushion 16 is secured to frame 12, it is not susceptible to displacement during frequent use, as is a typical removable cushion. Also, in the depicted embodiment, because the web outer perimeter 84 is located within the second outer perimeter 82 when viewed from an angle substantially normal the outer contact surface 64, the second back cushion portion 58 obscures the rim edge 44 of the back support portion 24 of the frame 12. Thus, the features that secure the back cushion 16 to the frame 12 are concealed and are not readily apparent when viewing the chair. In this manner, the removable back cushion 16 can be secured to the frame 12, while maintaining the casual appearance and aesthetic appeal of an article of furniture having removable cushions.

As also noted above, in various other embodiments, by itself or in addition to the back support surface, the seat support surface may be recessed to create a rim and pocket.

The seat cushion may also include first and second portions and a peripheral lip, wherein the first portion may be located adjacent the recessed seat support surface and the peripheral lip may be inserted into the pocket in a similar manner as described with respect to the back cushion. In this manner, the seat cushion may be secured to the frame while maintaining the casual appearance and aesthetic appeal of an article of furniture having removable cushions.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An article of furniture, comprising:

a frame comprising:

a seat support portion in an approximate horizontal orientation, said seat support portion having a seat support surface, a pair of lateral sides, and at least one other side extending between said lateral sides;

a back support portion extending adjacent said seat support portion in a vertical or slightly reclined orientation, said back support portion having a back support surface, a pair of lateral sides, and at least one other side extending between said lateral sides; and a plurality of legs supporting said seat support portion and said back support portion, a removable seat cushion that provides a user surface and is supported by said seat support surface; and a removable back cushion that provides a user surface and is supported by said back support surface, wherein at least a part of said seat support surface or said back support surface is recessed thus creating a rim that extends inward from said lateral sides and said other side to define a pocket between said rim and said recessed support surface, and wherein said cushion supported by said recessed support surface comprises a first portion and a second portion, said first portion defining an inner support surface and said second portion defining an outer contact surface, and wherein said first portion further defines a peripheral lip that is inserted into said pocket such that said inner support surface is adjacent said recessed support surface and said outer contact surface comprises the user surface, and wherein said first portion and said second portion of said cushion each are substantially enclosed by a cushion cover, with the cushion covers being interconnected at an intermediate web which lies inside an inner rim edge of said pocket.

2. The article of furniture of claim 1, wherein when said peripheral lip portion of said first portion of said cushion supported by said recessed support surface is inserted into said pocket, said inner rim edge is substantially obscured by said second portion of said cushion.

3. The article of furniture of claim 1, wherein said first portion defines a first outer perimeter, said second portion defines a second outer perimeter, and said intermediate web defines a web outer perimeter, and wherein when viewed from an angle substantially normal to said outer contact surface, said second outer perimeter is located within said first outer perimeter, and said web outer perimeter is located within said second outer perimeter, such that said peripheral lip of said first portion is defined as the part of said first portion located outside said web outer perimeter.

4. The article of furniture of claim 3, wherein said first portion further defines a first annular surface substantially perpendicular to said inner support surface and extending toward said second portion, and said second portion further defines a second annular surface substantially perpendicular to said outer contact surface and extending toward said first portion.

5. The article of furniture of claim 1, wherein said seat cushion and said back cushion are comprised of unitary components.

6. The article of furniture of claim 1, wherein said intermediate web is structured to allow at least some independent movement of said first portion and said second portion.

7. The article of furniture of claim 1, wherein said frame is constructed of a wicker material, said first and second cushion elements are constructed of a foam material, and said cushion cover is constructed of a fabric material.

8. The article of furniture of claim 1, wherein said cushion covers comprise a fabric.

9. The article of furniture of claim 1, wherein said first and second portions each comprise a foam material.

10. An article of furniture, comprising:

a frame comprising:

a seat support portion in an approximate horizontal orientation, said seat support portion having a seat support surface, a pair of lateral sides, and a front side extending between said lateral sides;

a back support portion extending adjacent said seat support portion in a vertical or slightly reclined orientation, said back support portion having a back support surface, a pair of lateral sides, and a top side extending between said lateral sides; and a plurality of legs supporting said seat support portion and said back support portion, a removable seat cushion that provides a user surface and is supported by said seat support surface; and a removable back cushion that provides a user surface and is supported by said back support surface, wherein at least a part of said back support surface is recessed thus creating a rim that extends inward from said lateral sides and said top side to define a pocket between said rim and said recessed back support surface, and wherein said back cushion comprises a first portion and a second portion, said first portion defining an inner support surface and said second portion defining an outer contact surface, and wherein said first portion further defines a peripheral lip that is inserted into said pocket such that said inner support surface is adjacent said recessed back support surface and said outer contact surface comprises the back cushion user surface, and wherein said first portion and said second portion of said back cushion each are substantially enclosed by a cushion cover, with the cushion covers being interconnected at an intermediate web which lies inside an inner rim edge of said pocket.

* * * * *